US005561267A

United States Patent [19]

Fudoo et al.

[11] Patent Number: 5,561,267

[45] Date of Patent: Oct. 1, 1996

[54] CRIMP TERMINAL AND PROCESS FOR PRODUCING THE SAME

[75] Inventors: Eiji Fudoo; Masayuki Kawamura, both of Yokkaichi, Japan

[73] Assignee: Sumitomo Wiring Systems, Ltd., Mie, Japan

[21] Appl. No.: 348,207

[22] Filed: Nov. 28, 1994

[30] Foreign Application Priority Data

Nov. 30, 1993 [JP] Japan ..... 5-300158

[51] Int. Cl.[6] ..... H01R 4/18

[52] U.S. Cl. ..... 174/84 C; 174/94 R; 439/877; 439/878

[58] Field of Search ..... 29/861, 863; 174/84 C, 174/94 R; 439/877, 878, 882

[56] References Cited

U.S. PATENT DOCUMENTS

| | | | |
|---|---|---|---|
| 3,330,903 | 7/1967 | Holke et al. | 174/94 |
| 3,387,080 | 6/1968 | Dibble et al. | 174/94 |
| 4,165,148 | 8/1979 | Campbell et al. | 339/276 R |
| 5,375,317 | 12/1994 | Murakami et al. | 29/753 X |
| 5,390,410 | 2/1995 | Takenami et al. | 29/753 X |
| 5,396,033 | 3/1995 | Piriz et al. | 174/94 R |
| 5,414,926 | 5/1995 | Ito et al. | 29/753 X |
| 5,432,995 | 7/1995 | Takenami et al. | 29/753 X |

FOREIGN PATENT DOCUMENTS 55-37840 9/1980 Japan .

*Primary Examiner*—Kristine L. Kincaid
*Assistant Examiner*—Chau N. Nguyen
*Attorney, Agent, or Firm*—Beveridge, DeGrandi, Weilacher & Young, LLP

[57] ABSTRACT

A crimp terminal having a crimp barrel crimped to an end of an electric wire is disclosed. The crimp barrel has a body of semicircular cross section and a couple of crimp wings which integrally extend from ends of the circular arc of the body and are caulked around the end of the electric wire in a mutually overlapped state. The crimp wings are overlapped and locked so they prevent each other from moving in a direction to release the overlap. It is preferred that each of crimp wings has a hook portion mutually locked on a locking surface. Also, a process for producing the crimp terminal is disclosed.

8 Claims, 14 Drawing Sheets

D1
D2
E
F
1
2
10
10a
10b
10c
A1
A2
T
W1
Q
S

CRIMP TERMINAL AND PROCESS FOR PRODUCING THE SAME

CROSS REFERENCE TO RELATED APPLICATION

This application claims priority benefits under 35 USC §119 of Japanese Patent Application No. 5-300158, the disclosure of which is incorporated by reference.

1. Field of the Invention

The present invention relates to an opened barrel type crimp terminal and a process for producing the same.

2. Description of Related Art

Heretofore, an opened barrel type crimp terminal shown in FIG. 10 has been used as one of crimp terminals crimped on an end of an electric wire. This crimp terminal 90 has a barrel 90A to be crimped to the core wire W1 on an end of an electric wire W. The portion 90*c* is a rectangular cylinder to be connected to another terminal. The barrel 90A has a body 90B of semicircular section, a pair of wire crimp wings 91 respectively integrally extended from both ends of the body 90B and a pair of insulation crimp wings 92 respectively integrally extended from both ends of the body 90B. Said pair of wire crimp wings 91 are caulked to the core wire W1, and said pair of insulation crimp wings 92 are caulked to the insulated end W2.

When the crimp terminal 90 is crimped, the core wire W1 of the electric wire W is introduced between wire crimp wings 91, and the insulated end W2 is introduced between insulation crimp wings 92. In the terminal crimping device provided with two pairs of crimpers 93 and anvils 94, the respective crimpers 93 caulk wire crimp wings 91 and insulation crimp wings 92 received by the corresponding anvils 94, whereby to crimp the crimp terminal 90 to the end of the electric wire W.

As the method for crimping the wire crimp wing 91, there can be normally used the following methods.

i) Referring to FIG. 11, a so-called overlap crimping method comprising overlapping the tip end 91*a* of one of wire crimp wings 91 on the outer side of the tip end of the other wire crimp wing 91 (see Japanese Laid-Open Patent Publication No. 3-165478), and ii) referring to FIG. 12, a so-called B type crimping method comprising cutting both tip ends 91*a*, 91*b* into the core wire W1 of the electric wire W while contacting respective tip ends 91*a*, 91*b* of the respective wire crimp wings 91 with each other (see Japanese Patent Publication No. 55-37840).

In the overlap crimping method shown in the above item i), the respective wire crimp wings 91 may open out in the direction of releasing overlap due to elastic restoring force, which results in deterioration of electric/mechanical joining performance.

Therefore, it is also carried out to prevent the respective wire crimp wings 91 from opening out by bending themselves to an acute angle (see Japanese Utility Model Publication No. 52-24784). However, also in this case, the tip ends 91*a*, 91*b* are only in mutual contact so that it is impossible to prevent the respective wire crimp wings 91 from opening out when the core wire W1 is thermally expanded. This leads to the problem that electric/mechanical joining performance between the crimp terminal 90 and core wire W1 are liable to deteriorate due to the repetitive thermal expansion and shrinkage of the core wire W1 due to heat, thus being unsuitable for wiring employed under large vibration conditions such as that of a wire harness for automobiles.

Also, in the B type crimping method in the above item ii), both tip ends 91*a*, 91*b* are in contact with each other at the center of the barrel 90A while both wire crimp wings 90 are bending in approximately circular form. Accordingly, even if the respective wire crimp wings 91 are pressed to the opening direction by the thermal expansion of the core wire W1, the pressing power due to the respective wire crimp wings 91 is mutually canceled at the contact position thereof. As a result, it is possible to prevent the respective wire crimp wings 91 from opening out.

However, in the B type crimping method, the core wire W1 sometimes is shifted to any one of the wire crimp wings 91 at the time of crimping, thereby generating a difference in clamping power to the core wire W1 between right and left wire crimp wings. In this case, the contact resistance between the crimp terminal 90 and core wire W1 becomes large and the desired electric joining performances can not be obtained. Also, scattering is generated in the crimp strength as to the core wire W1 and the desired mechanical joining performance can not be obtained. Further, since the respective wire crimp wings 91 bite into the core wire W1, the core wire W1 is damaged and broken on use, it becomes impossible to obtain the desired electric joining performance.

On the other hand, as one of connectors for conducting electric connection between electric wires, there has hitherto been provided a crimp connector capable of crimping a crimp terminal to electric wires in the interior of a connector housing.

This crimp connector is, as shown in FIG. 13, provided with a opening 101, 102 on the upper and lower surfaces of the connector housing 100, and cover these openings with a cover 103, 104 to allow opening and closing. Further, the connector housing 100 is provided with a plurality of crimp terminal insert sections 105 arranged in lines.

According to this crimp connector, the wire crimp wings 91 can be crimped to the core wire W1 at the end of the electric wire W by inserting the crimpers 93 through the respective crimp terminal insert sections while inserting the crimp terminals 90 into crimp terminal insert sections to caulk the wire crimp wings 91 of the crimp terminal 90 between crimpers and anvils 94. Further, by applying a pressure while receiving the insulation crimp wings 92 of the crimp terminal 90 at the bottom of the connector housing 100, it is possible to crimp the insulation crimp wings 92 to the insulated end of the wire W. The crimp connector has such an advantage that the crimping operation between the electric wire W and crimp terminal 90 can be conducted easily and quickly, and is extremely suitable for automating the fabrication of wire harness.

However, since a crimp width D (see FIGS. 11 and 12) is increased in both overlap crimping and B-type crimping methods, the width between the crimper 93 and the anvil 94 for caulking is also increased so that the crimper 93 can not be inserted into the crimp terminal insert section 105 of the crimp connector. Therefore, it can not be applied as the crimping method for crimp connector.

Moreover, the crimper 93 used for overlap crimping is provided with a groove 93*a* for introducing the respective wire crimp wings 91, and formed on the inner surface 930 of this groove 93*a* are a 1st first curved surface 93*c* and a 2nd second curved surface 93*d*, made smoothly continuous by providing a level difference (see FIG. 11). At the time of crimping, by applying a pressure while clipping the wire crimp wings 91 between 1st and 2nd curved surfaces 93*c*, 93*d* and anvils 94, tip end 91*a* of one of the wire crimp wings 91 is fitted to the corresponding 1st curved surface 93*c*, and the tip end 91*b* of the other of the wire crimp wings 91 is fitted to the corresponding 2nd curved surface 93*d*, respectively. By utilizing the level difference 93*b* at the border section between these curved surfaces 93*c*, 93*d*, the tip ends of the crimp wings 91, 92 are offset to each other, and then one of the tip end 91*a* of the wire crimp wing 91 is overlapped on the outer periphery side of the tip end 91*b* of the wire crimp wing 91, thereby caulking them.

However, when a crimp terminal 90 with narrow crimp width d for thin wires is subjected to an overlap crimping using the above crimper 93, the tip end 91*a* of one of wire crimp wings 91 and the tip end 91*b* of the other wire crimp wing 91 may sometimes collide with each other without being overlapped to each other (see FIG. 14C).

This is because that, when the wire crimp wings 91 of the crimp terminal 90 is introduced into the groove 93*a* of the crimper 93, the tip end 91*a* of one of the wire crimp wings 91 and the tip end 91*b* of the other of the wire crimp wings 91 are firstly butted to each other while contacting with the 1st curved surface 93*c* (see FIG. 14A), and the crimping operation proceeds without canceling this butted state (see FIGS. 14B and 14C). In this case, the section to be connected to the body 90B of the wire crimp wing 91 is buckled when the wire crimp wing 91 can not be escaped and, further, a wrinkle-like cracking K is arisen and the crimped section is liable to be opened, thereby causing deterioration of electric/mechanical joining performances between the crimp terminal 90 and core wire W1.

SUMMARY OF THE INVENTION

The present invention has been accomplished in order to solve the above problems. That is, a main object of the present invention is to provide a crimp terminal which is superior in electric/mechanical joining performance and can be applied to crimp connector, and a process for producing the same.

In order to accomplish the above object, one embodiment of the present invention is directed to a crimp terminal comprising a crimp barrel, said crimp barrel comprising a body of semicircular cross section and a couple of crimp wings which are respectively integrally extended from ends of the circular arc of said body and are caulked around an end of an electric wire;

wherein one of said crimp wings is lapped over an outside of the other so that said crimp wings are overlapped with each other; and wherein said crimp wings are locked together so as to prevent each other from moving in a direction to release a overlapped state.

According to this embodiment, by means of a mutual locking of the crimp wings, it is possible to prevent the crimp wing from moving in the direction to release the overlap, thus it is superior in electric/mechanical joining performance to the electric wire. Also, it is possible to prevent the respective crimp wings from opening out due to thermal expansion of the core wire so that the crimp height can be increased and the crimp width can be reduced. Accordingly, it can also be applied to a crimp connector for conducting terminal crimping in the interior of the connector housing.

It is preferred that each of said crimp wings has a hook portion having a locking surface, said hook portions of said crimp wings being locked to each other at said locking surfaces. In this case, opening of crimp wings can be safely prevented.

Another embodiment of the present invention directs to a process for producing a crimp terminal which has a crimp barrel caulked on an end of an electric wire, the crimp barrel having a body of semicircular cross section and a couple of crimp wings which are integrally extended from ends of circular arc of the body and are caulked around the end of the electric wire, which comprises:

placing the body of the crimp barrel containing the end of the electric wire on a pressure receiving surface of a pressure receiving means;

displacing a pressing surface of a pressing means to the pressure receiving surface to lead one of the crimp wings of the crimp barrel to an outer periphery of the other crimp wing by means of the pressing surface, thereby overlapping them; and locking the crimp wings to each other by means of additional displacement of the pressing surface so that the crimp wings prevent each other from moving in a direction to release overlapped portions.

According to this embodiment, by locking the crimp wings along with the overlap operation of the crimp wings, it is possible to prevent the crimp wings from moving in the direction to mutually release the overlap, thus it is superior in electric/mechanical joining performances to the electric wire. Also, it is possible to prevent the respective crimp wings from opening out due to thermal expansion of the core wire so that the crimp height can be increased and the crimp width can be reduced. Accordingly, it can also be applied to a crimp connector for conducting terminal crimping in the interior of the connector housing.

DETAILED DESCRIPTION OF THE PREFERRED EMBODIMENTS

Hereinafter, the present invention will explained in detail with reference to the accompanying drawings showing Examples.

Figure 2:
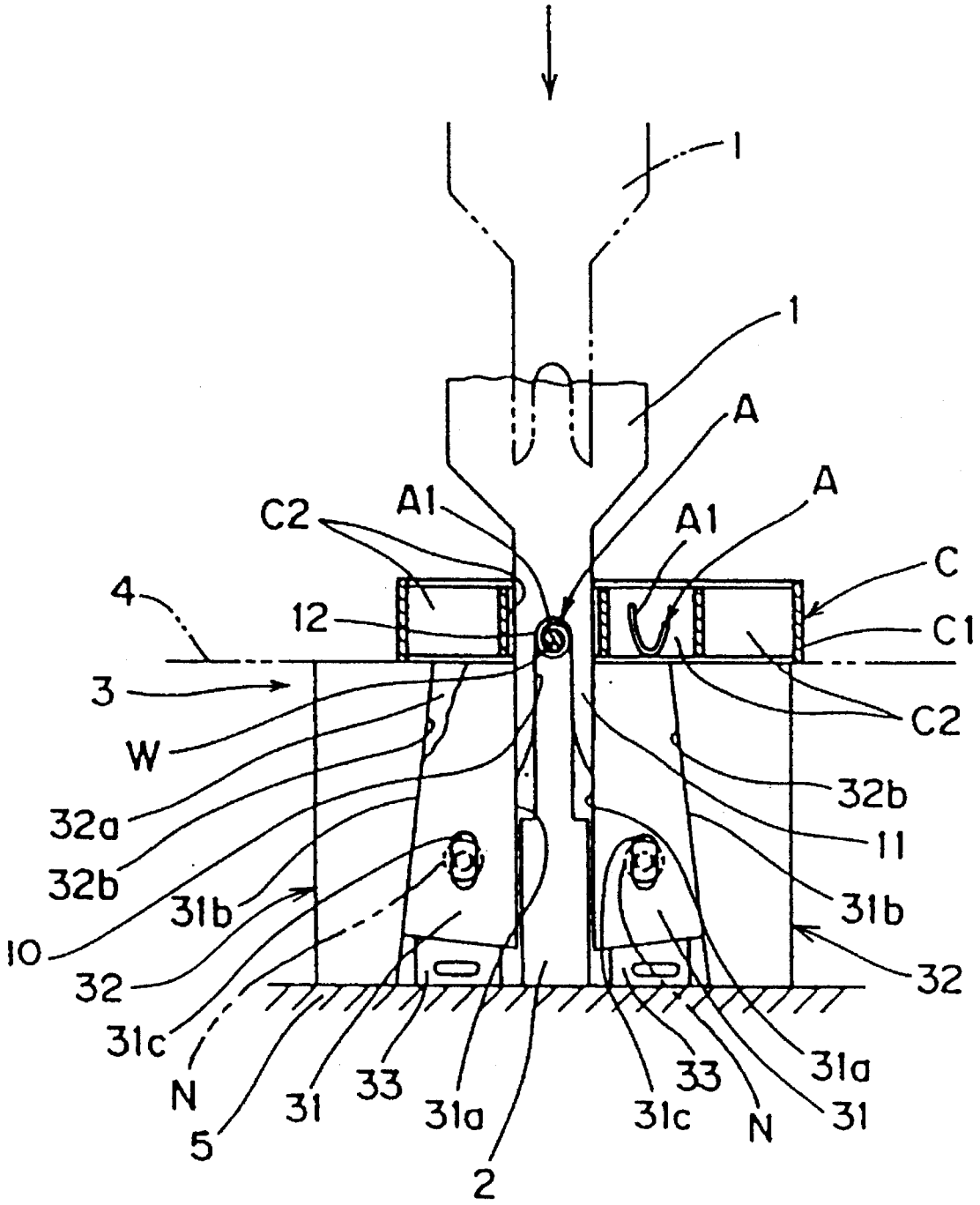
FIG. 2 is a sectional view illustrating a principal construction of a terminal printing device.

Referring to FIG. 2, this terminal crimping device is provided with a crimper 1 as a pressing means for clipping and caulking a crimp terminal A incorporated into the interior of a connector housing C1 of a crimp connector C, an anvil 2 as a pressure receiving means and a claw portion clipping member 3 for preventing the crimper 1 from opening out by clipping tip ends of the crimper 1.

The crimp terminal A is provided with a barrel AB to be caulked to an end of an electric wire W and a rectangular cylinder AC for connecting to an other terminal, which is formed continuously with the barrel. The barrel AB is provided with a body AB1 of approximately circular section, a pair of wire crimp wings A1, A2 to be crimped to a core wire W1 of the electric wire W and a pair of insulation crimp wings A3, A4 to be crimped to a insulated end W2 of the electric wire W, which are continuously formed at both ends of the body AB1.

Figures 1A, 1B, 1C, 1D, 1E, 1F:
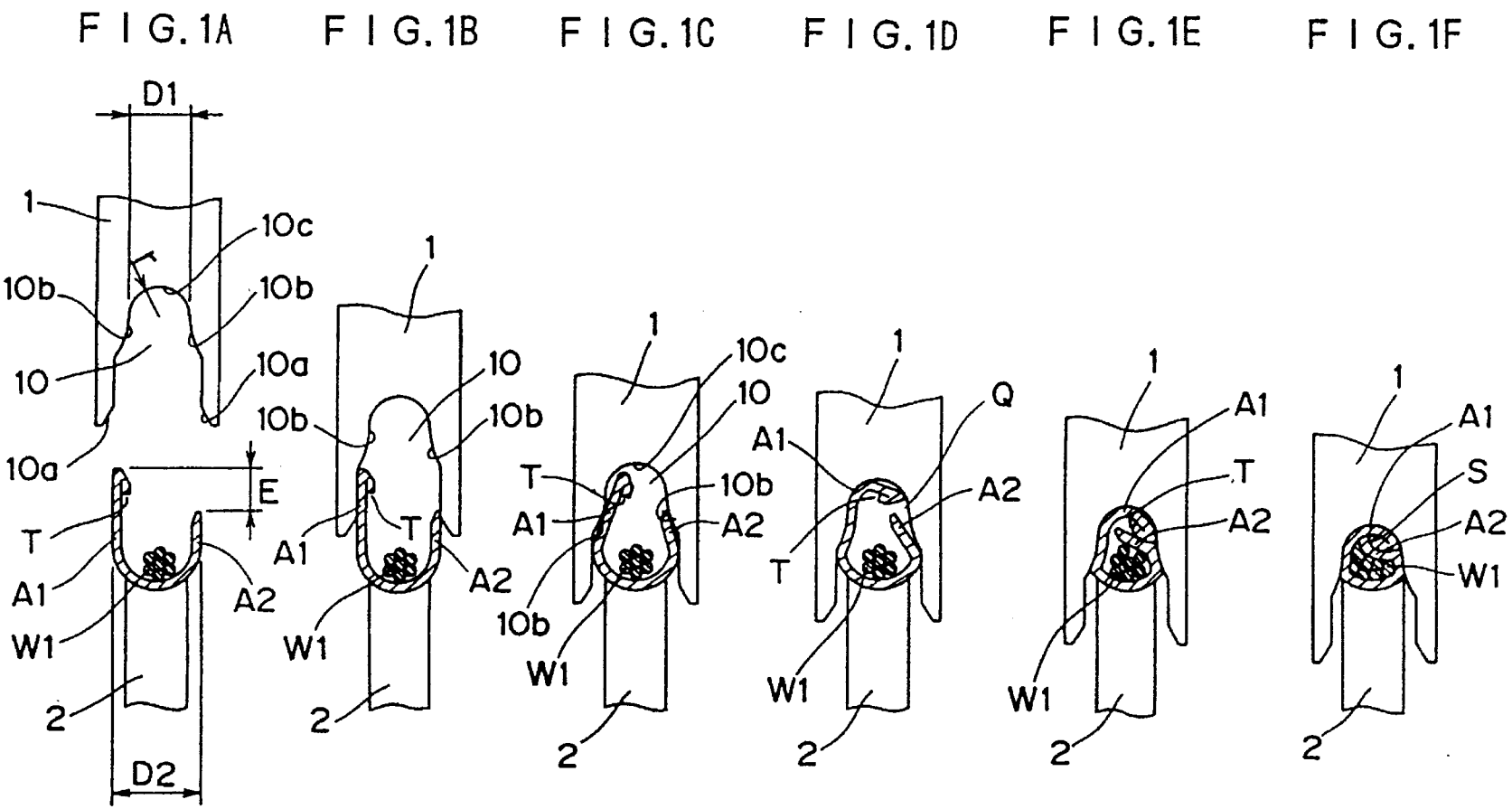
FIGS. 1A to 1F are schematic sectional views illustrating the fabrication processes of a crimp terminal of the present invention.
Figure 4:
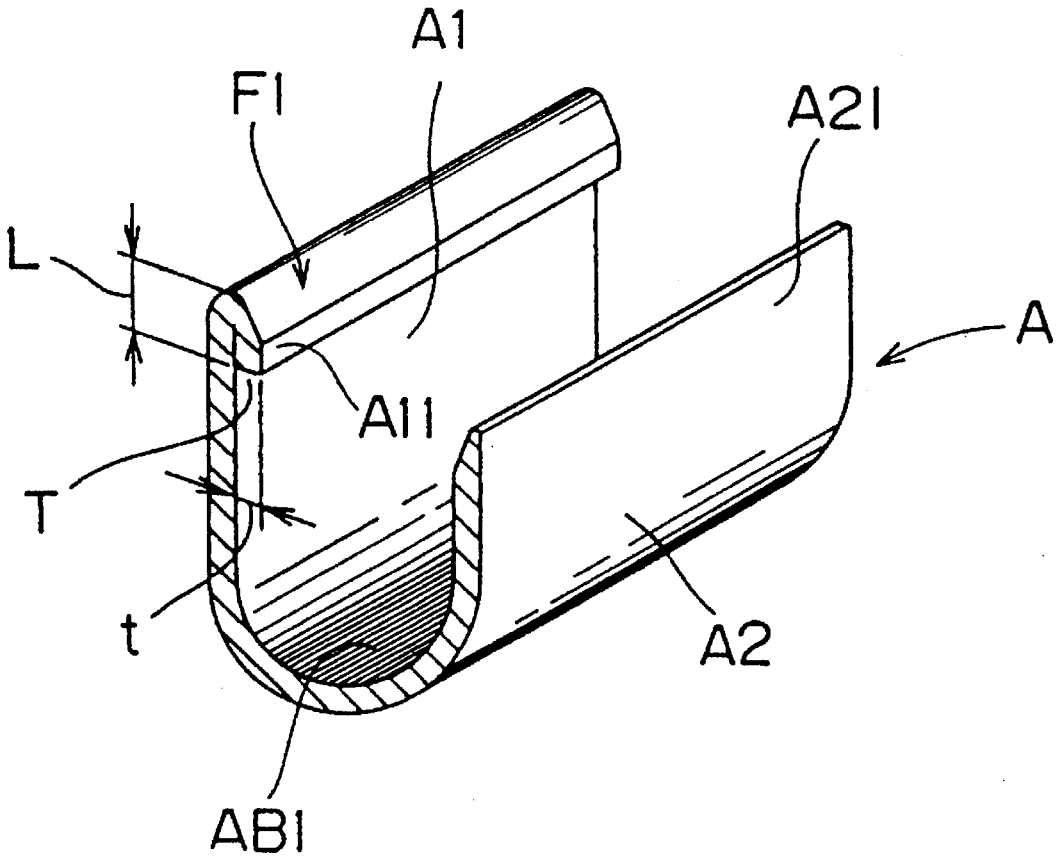
FIG. 4 is a partial sectional view illustrating a crimp terminal of FIG. 3 prior to crimping.

The wire crimp wing A1 prior to crimping is, as shown in FIG. 1A, made longer by a level difference E than the other wire crimp wing A2, and a tip end A11 of the other wire crimp wing A1 is projected in comparison with a tip end of the other wire crimp wing A2. Also, as shown in FIG. 4, the tip end A11 of the wire crimp wing A1 forms a hook portion F1 having a stepped section T by being folded and overlapped.

The stepped section T of this hook portion F1 is for locking the tip end A21 of the other wire crimp wing A2 when the wire crimp wings A1, A2 are crimped to the core wire W1 of the electric wire W. The level difference t of the stepped section T is approximately set to a thickness of the wire crimp wing A1, and a distance L from the tip A11 end of the wire crimp wing A1 to the stepped section T is set about two to four times the thickness of the wire crimp wing A1.

The crimper 1 is provided movably up and down between an upper position where the crimper 1 is disposed over the connector housing C1 and an lower position where the crimper 1 is inserted into the connector housing C1. By lowering the crimper 1 to the lower position by means of a ram of a press machine (not shown), the wire crimp wings A1, A2 of the crimp terminal A placed on the anvil 21 can be pressed. This crimper 1 can be inserted into a plurality of crimp terminal insert sections C2 provided serially on the connector housing C1. Formed on the lower end of the crimper 1 are a pair of claw portions 11. Between the claw portions 11, a groove 10 for caulking the wire crimp wings A1, A2 of the crimp terminal A is formed in cooperation with the anvils 2.

On the open side end of the groove 10, as shown in FIG. 1, are formed a pair of introduction guide portions 10*a* for guiding the introduction of the wire crimp wings A1, A2 respectively continuous with the introduction guide portion 10*a*, there is formed a concave portion 10*c* for bending the respective wire crimp wings A1, A2 to overlap one of the wire crimp wings A1 to the other wire crimp wing A2. The concave portion 10*c* is formed of a single curved surface of approximately semicircular shape and its radius r is set to satisfy an equation $\pi r/2=E$ as the level difference between one of the wire crimp wings A1 and the other wire crimp wings A2.

Incidentally, a groove width D1 in the pressing section 10*b* is set smaller by a predetermined width than the whole width D2 in the wire crimp wings A1, A2 of the crimp terminal A. This is for the purpose of inclining both wire crimp wings A1, A2 in the mutually approaching directions, and in this inclined state, crossing the extension lines of the tip ends of one of the wire crimp wings A1 and of the other wire crimp wings A2 in the approximate center of the groove 10.

The anvil 2 is fixed to the lower side of the connector housing C1, with its upper end projecting at a predetermined height from the set position (see FIG. 2) of the connector housing C1. Therefore, the upper end of the anvil 2 may be introduced into the crimp terminal insert section C2 with the connector housing C1 set in the set position 4.

The claw clipping members 3 are provided with a pair of clipping pieces 31 for crimping both claw portions 11, holding members 32 for holding these clipping pieces 31 vertically slidable and spacers 33 for adjusting the height of the clipping pieces 31. The claw clipping member 3 is for clipping both claw portions 11 of the crimper 1 when caulking the crimp terminal A for preventing both claw portions 11 from mutually separating from each other.

The clipping pieces 31 comprise a perpendicular surface 31*a* in contact with the claw portion 11 and an inclined surface 31*b* formed on the opposite side of the one surface 31*a* with its upper portion gradually approaching to the claw portion 11.

Further, each of the clipping pieces 31 is formed with insert through hole 31*c* for inserting a screw N there through to be fixed to the corresponding holding member 32. Each of the insert through holes 31*c* is made a longitudinal hole to allow a travel adjust of the corresponding clipping piece 31 in the vertical direction.

Also, between the holding members 32 there is a groove portion 32*a* enabling to introduce the clipping pieces 31 thereinto, and a pair of side walls 32*b* of the groove portion 32*a* is respectively in contact with the inclined surfaces 31*b* of the clipping pieces 31.

Each of the spacers 33 is provided between a base 5 for fixing the holding members 32 and the bottom surface of the corresponding clipping piece 31, and the mutual contact surfaces of the clipping pieces 31 and the spacer 33 are mutually formed into inclined surfaces, respectively. Also, each of the spacers 33 is provided horizontally movable along the base 5, and by adjusting its travel amount in the horizontal direction enables to travel adjust the corresponding clipping piece 31 in the vertical direction. Thus, by travel adjusting the clipping pieces 31 in the vertical direction, the gap between the claw portion 11 and the clipping pieces 31 can be adjusted to approximately 0.

Incidentally, the terminal crimping device is constructed with a punch (not shown) for caulking the insulation crimp wings A3, A4 of the crimp terminal A by clipping the insulated end W2 of the wire W between it and the bottom section of the connector housing C1 so that the punch is movable together with the crimper.

Next, crimping processes will be explained.

1) First, as shown in FIG. 1, the crimp terminal A inserted into the crimp terminal insert section C2 of the connector housing C1 is supported by means of the anvil 2.

2) In this state, the crimper 1 is lowered to introduce into the insert section of the crimp terminal C2 of the connector housing 1, thereby, the wire crimp wings A1, A2 of the crimp terminal A are respectively guided by means of the introduction guide portions 10*a* of the crimper 1 to introduce them into the groove 10, as shown in FIG. 1B.

3) The crimper 1 is further lowered, as shown in FIG. 1C, to incline the wire crimp wings A1, A2 in the mutually approaching direction by means of the pressing sections 10*b* respectively.

4) The crimper 1 is further lowered, as shown in FIG. 1D, the longer wire crimp wing A1 collides with the bent section 10*c* of the groove 10.

5) The crimper 1 is further lowered, as shown in FIG. 1E, the wire crimp wing A1 is gradually bent along the bent section 10*c* of the groove 10.

Figure 5:
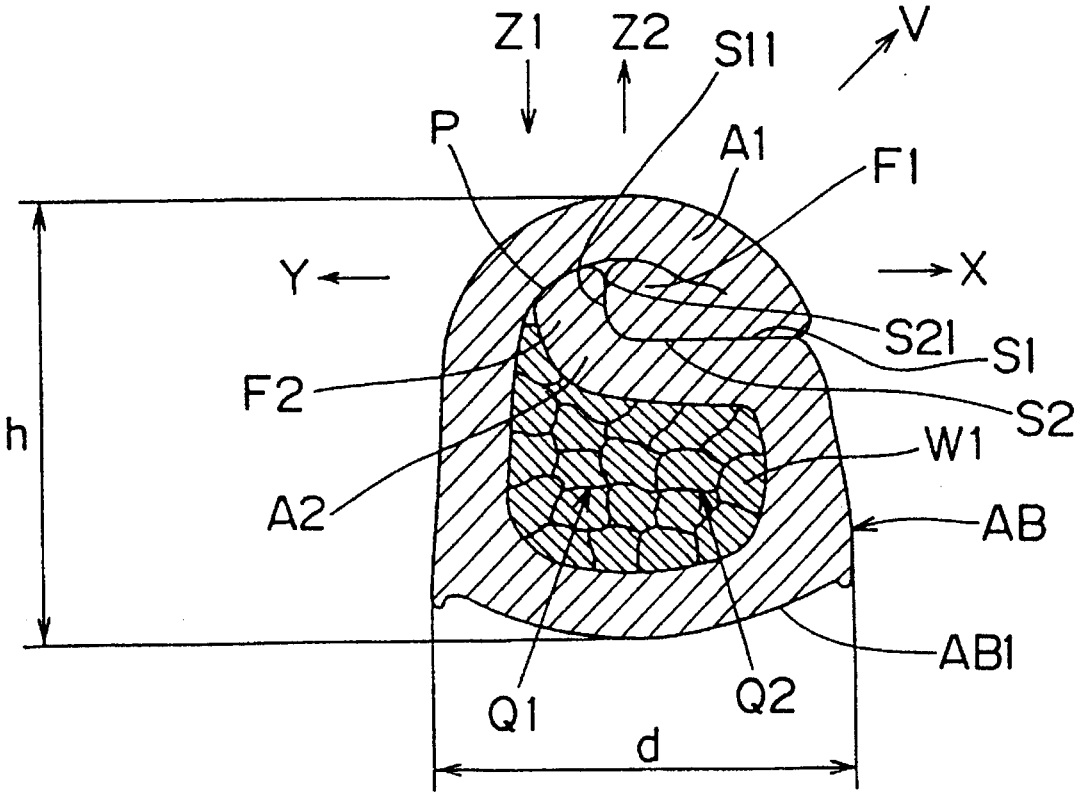
FIG. 5 is a sectional view illustrating a crimp terminal of FIG. 3 after crimping.

6) In this state, the crimper 1 is lowered, as shown in FIGS. 1F and 5, to overlap the bent longer wire crimp wing A1 on the outer side of the other wire crimp wing A2. A hook portion F2 is formed by bending the tip end portion A21 of the shorter wire crimp wing A21 in the upward direction which is in reverse to the bending direction for overlapping, on parallel with this overlap. According to the above processes, the wire crimp wings A1, A2 of the crimp terminal A can be crimped around the core wire W1 section of the wire W.

On the respective locking surfaces S1, S2 of the hook portions F1, F2, the approximately downward-extending sections S11, S12 are contained. Further, the tip end surface P of the wire crimp wing A2 is butted against the side surface without the wire crimp wing A1 thereon. Such a crimping form can be obtained by properly selecting the position of the stepped section T and the mutual level difference E between the wire crimp wings A1, A2 in accordance with the other diameter of the core wire W1.

According to the above embodiments, the following effects can be obtained.

1) Since this is an overlapped crimping process for overlapping wire crimp wings A1, A2 of the crimp terminal A, there is no fear of the core wire W being shifted in the right or left direction like the B type crimping and the desired electric/mechanical joining performance can be obtained. Also, since there is no fear of damaging the core wire W1 due to the wire crimp wings A1, A2, it is possible to prevent the core wire W1 from being broken on use.

2) Since the hook portions F1,F2 respectively formed on the tip ends of the wire crimp wings A1, A2 are locked together, it is possible to prevent the wire crimp wings A1, A2 from opening out due to thermal expansion of the core wire W1. Therefore, it is possible to prevent deterioration of the electric/mechanical joining performance.

3) Since the locking surfaces S1, S2 of the hook portions F1, F2 are provided with the sections following the vertical directions S11, S12, it is possible to exert especially strong resistance against the component forces X, Y, which act in the direction of directly crossing with the press direction Z1 (pressing direction of the press machine) due to thermal expansion of the core wire W1.

Incidentally, the sections S11, S12 may not necessarily follow in the vertical direction, but may approximately follow in the direction of the curvature radius (e.g. Q1, Q2) of the body AB1 of the barrel AB.

4) Against the inner side surface of the location sufficiently distant from the tip end of the wire crimp wings A1, the top end surface P of the other wire crimp wing A2 is butted. Therefore, among the elastic reactive force V wherein the wire crimp wing A2 tends to release overlap and open itself, the component power Z2 acting in the reverse direction to the pressing direction Z1 will be applied to the location sufficiently distant from the tip end of the wire crimp wing A1. Accordingly, it is possible to more efficiently prevent the respective wire crimp wings A1, A2 from opening due to thermal expansion of the core wire W1.

Since the wire crimp wings A1, W2 are prevented from opening out, it is possible to increase the crimp height h and reduce the crimp width d. As a result, it becomes possible to conduct terminal printing in the connector housing C1.

5) Since the wire crimp wings A1, A2 are introduced into the groove 10 of the crimper 1 in the state where the tip end of the wire crimp wings A1 is projected by the predetermined length from the tip end of the other wire crimp wing A2, the tip ends of the wire crimp wings A1, A2 will never but each other deep inside the groove 10 of the crimper 1.

6) Since the wire crimp wings A1, A2 can be inclined in the mutually approaching directions, a gap Q will be formed between the tip end of the wire crimp wing A2 and the concave portion 10*c* of the groove 10 (see FIG. 1D), when overlapping the longer wire crimp wing A1 onto the shorter wire crimp wing A2 after the wire crimp wing A1 are bent along the bent section 10*c*, it is possible to lead the tip end of the longer wire crimp wing A1 on the outer side of the wire crimp wing A2. Therefore, as to the crimp terminal A with small crimp width d, the overlap crimping can be conducted firmly.

7) On the other hand, as to the thermal crimping device, since it is possible to continuously conduct the process of inclining the wire crimp wings A1, A2 by crimping the wire crimp wings A1, A2 of the crimp terminal A into the groove 10 of the crimper 1, these processes can be easily and efficiently conducted.

8) Moreover, since the bent section 10*c* of the groove 10 is formed of a single curved surface, it is possible to form the bent section 10*c* more easily in comparison with a conventional one composed of two curved surfaces with level difference formed therebetween.

9) Moreover, since the relationship between the radius r of the concave portion 10*c* and the level difference E of a pair of wire crimp wings A1, A2 is set to satisfy the equation $\pi r=E$, when the longer wire crimp wing A1 is bent and follow about ¾ of the range of the concave portion 10*c*, the top end portion of the other wire crimp wing A2 will approach to the tip end portion of the wire crimp wing A1. Therefore, it is possible to lead the longer wire crimp wing A1 to the outer side of the wire crimp wing A2 more firmly.

10) Also, when the crimp terminal A is crimped, it is possible to prevent the claw portion 11 from opening out by clipping the claw portions 11 of the crimper 1. Therefore, it is possible to surround the wire crimp wings A1, A2 of the crimp terminal A between the crimper and anvil 12 without any gap. Accordingly, it becomes possible to caulk the wire crimp wings A1, A2 with a considerable pressure and the wire crimp wings A1, A2 can be firmly and strongly crimped to the core wire of the wire W.

Figure 6:
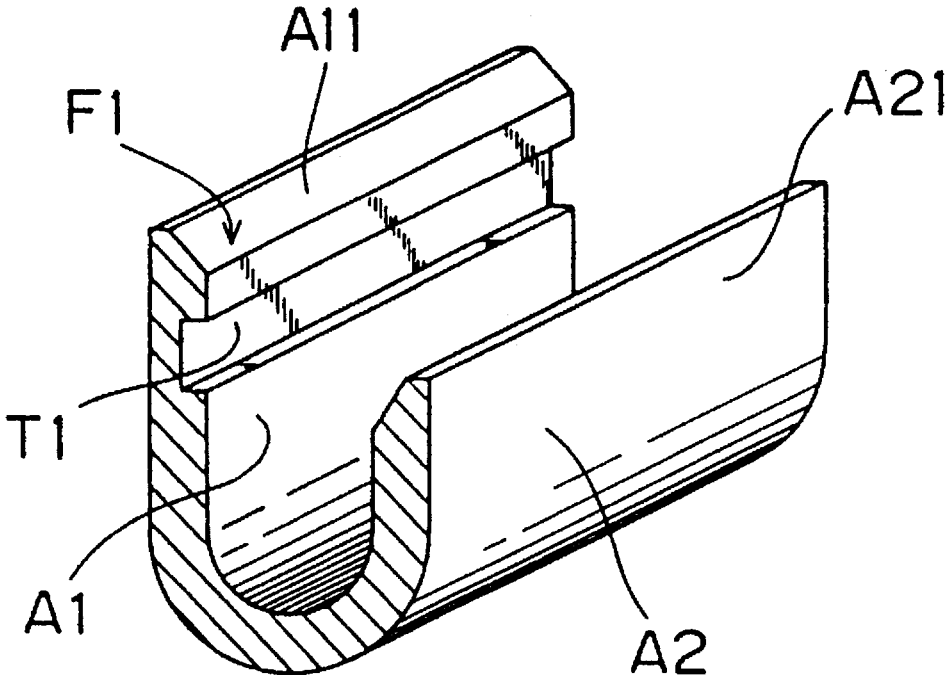
FIG. 6 is a partial sectional view illustrating a crimp terminal of another embodiment of the present invention.

Incidentally, the hook portion F1 formed on the wire crimp wing A1 in advance can be formed by various methods, for example, it is also possible to provide a concave groove T1, as shown in FIG. 6.

Figure 3:
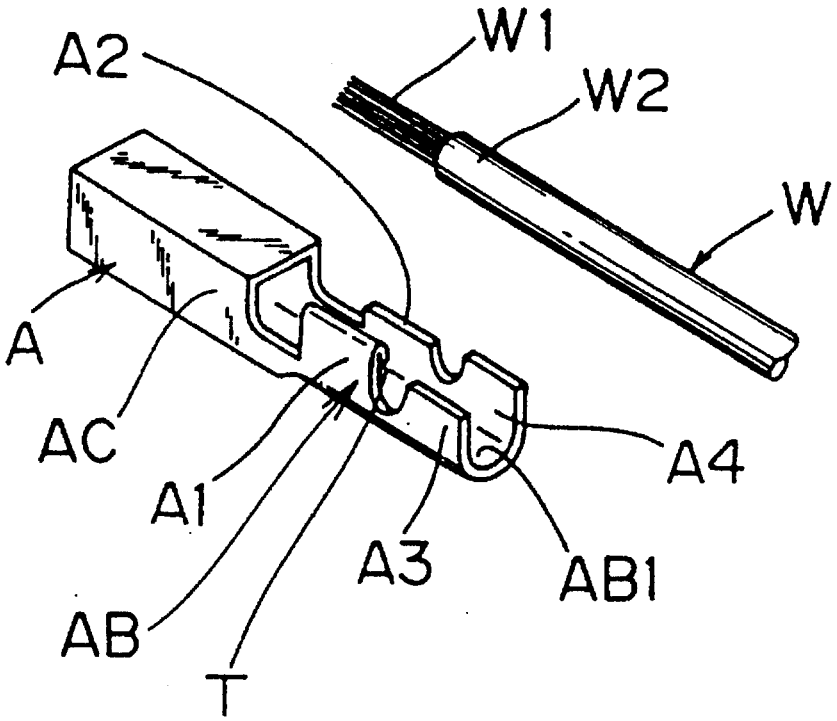
FIG. 3 is a perspective view illustrating a crimp terminal and an electric wire of one embodiment of the present invention prior to crimping.
Figure 7:
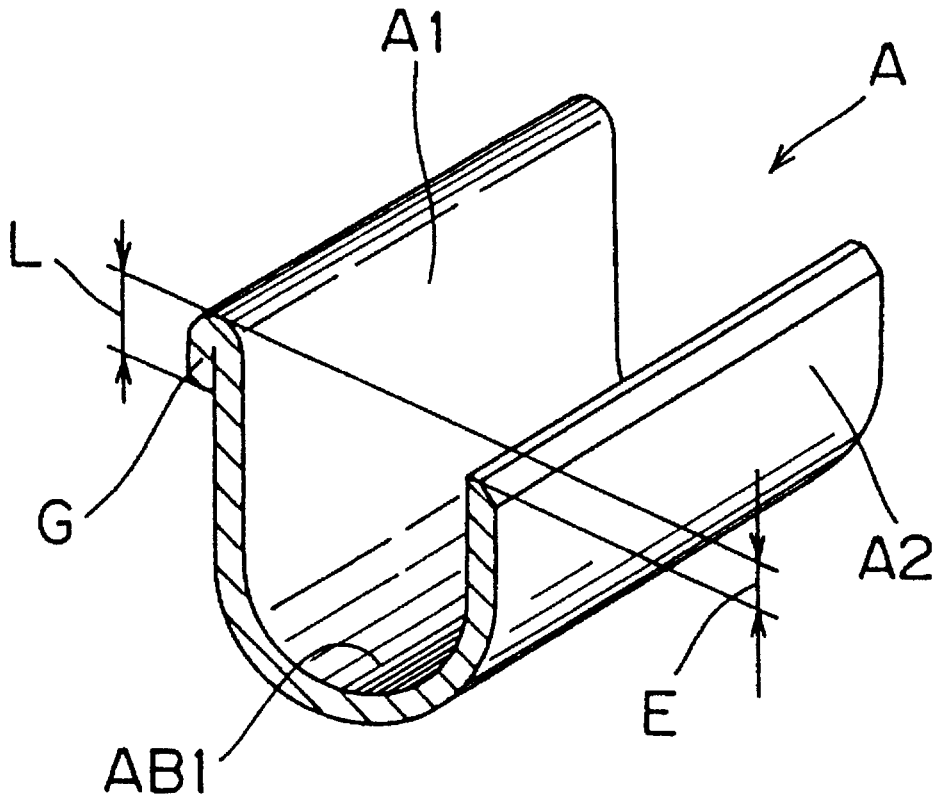
FIG. 7 is a partial sectional view illustrating a crimp terminal of still another embodiment of the present invention.

Referring to FIG. 7, a crimp terminal of another embodiment will be explained. This crimp terminal A prior to crimping is different from crimp terminals prior to crimping shown in FIGS. 3 and 4 in this respect. That is, the tip end A11 of one of the wire crimp wings A1 is folded over externally, and the thickened section G is formed of a portion overlapped with the folded portion.

The purpose of this thickened portion G is, in the process of crimping the wire crimp wings A1, A2 to the core wire W1 of the electric wire W, along with bending the tip end itself of one of the wire crimp wings A1 downward, simultaneously with this formation of the hook portion F3, to form curved hook portion F4 on the other wire crimp wing A2.

On the surfaces S1, S2 of the hook portions F3, F4, the convex curved surface S12 formed inside the hook portion F3 and the concave curved surface S22 outside the hook portion F4 are contained, respectively. Regarding this crimp terminal, the distance from the tip end of the wire crimp wing A1 is set about two to four times the thickness of the wire crimp wing A1. Also, the top end of the wire crimp wing A1 is projected by the predetermined length from the top end of the other wire crimp wing A2 so as to be provided with a level difference at the top thereof.

Figure 8:
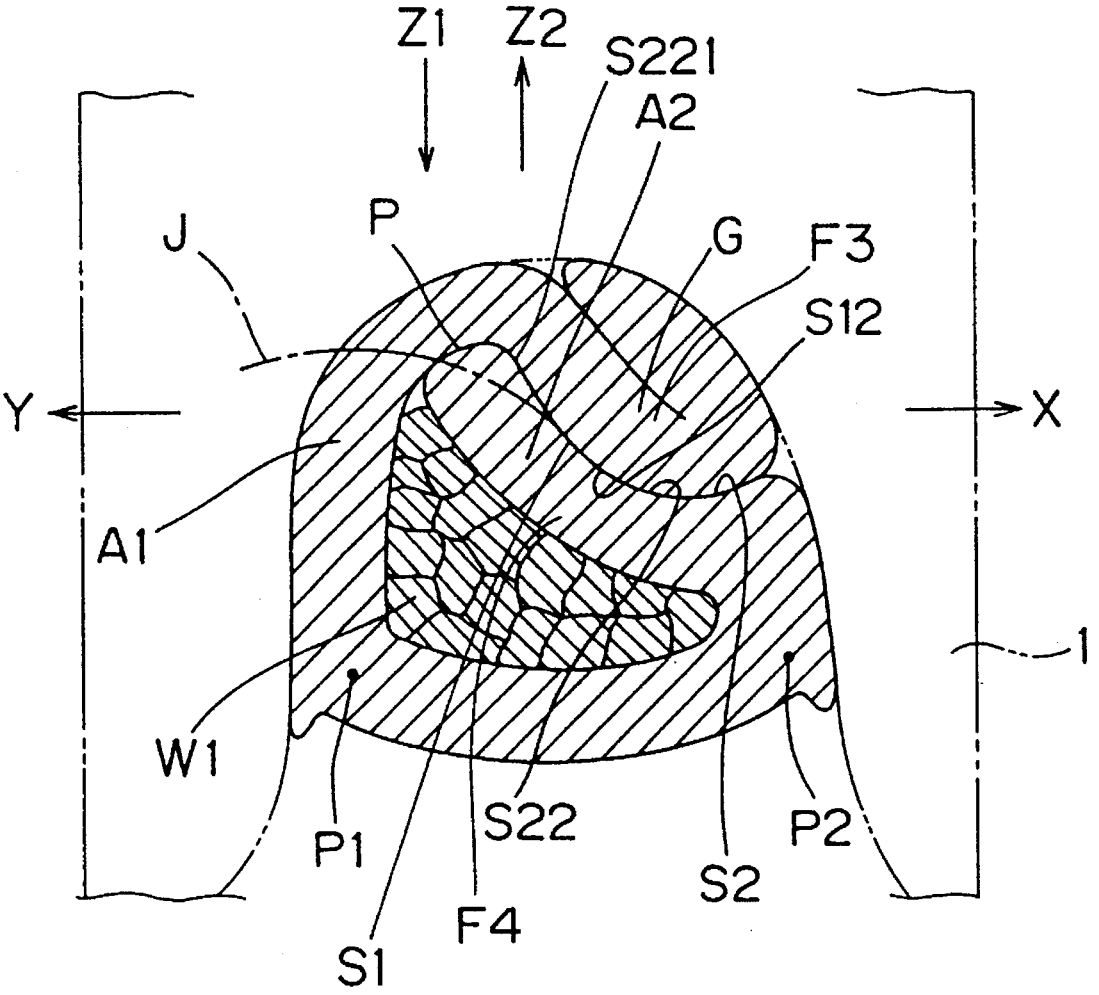
FIG. 8 is a partial sectional view illustrating a crimp terminal of still another embodiment of the present invention.

Referring to FIG. 8, the wire crimp wing A2 locks the concave curved surface S22 thereof with the convex curved surface S12 of the wire crimp wing A1, and the tip end surface P thereof is butted to the internal side curved surface of the wire crimp wing A1. Also, the concave curved surface S22 includes the externally projecting section S221 from the circular line J with one corner point P1 as a center.

According to this embodiment, in addition to the same effect as that of the embodiment of FIG. 1, the following effect can be obtained. In the crimp terminal after the completion of the crimping, when the core wire W1 is thermally expanded, the hook portion F3 of the wire crimp wing A1 tends to open out to the left side along the circular line J, thus opening action can be received via the section S22 of the concave curved surface S22 of the wire crimp wing A2.

Also, along with the thermal expansion of the core wire W1, it tends to open out the wire crimp wing A2 in the right direction with the other corner point P2 as the starting point, as shown, this opening action can be received via the convex curved surface S12 of the wire crimp wing A1.

Therefore, among the elastic restoring force generated in the wings A1, A2 due to the thermal expansion of the core wire W1, it can exert strong resistance against the component power X, Y, directly crossing the pressing direction Z1. Moreover, strong resistance can be asserted to the component power, against the inner side of the wire crimp wing A1, at the location sufficiently distant from the tip end surface of one of the wire crimp wings A1.

Figure 9:
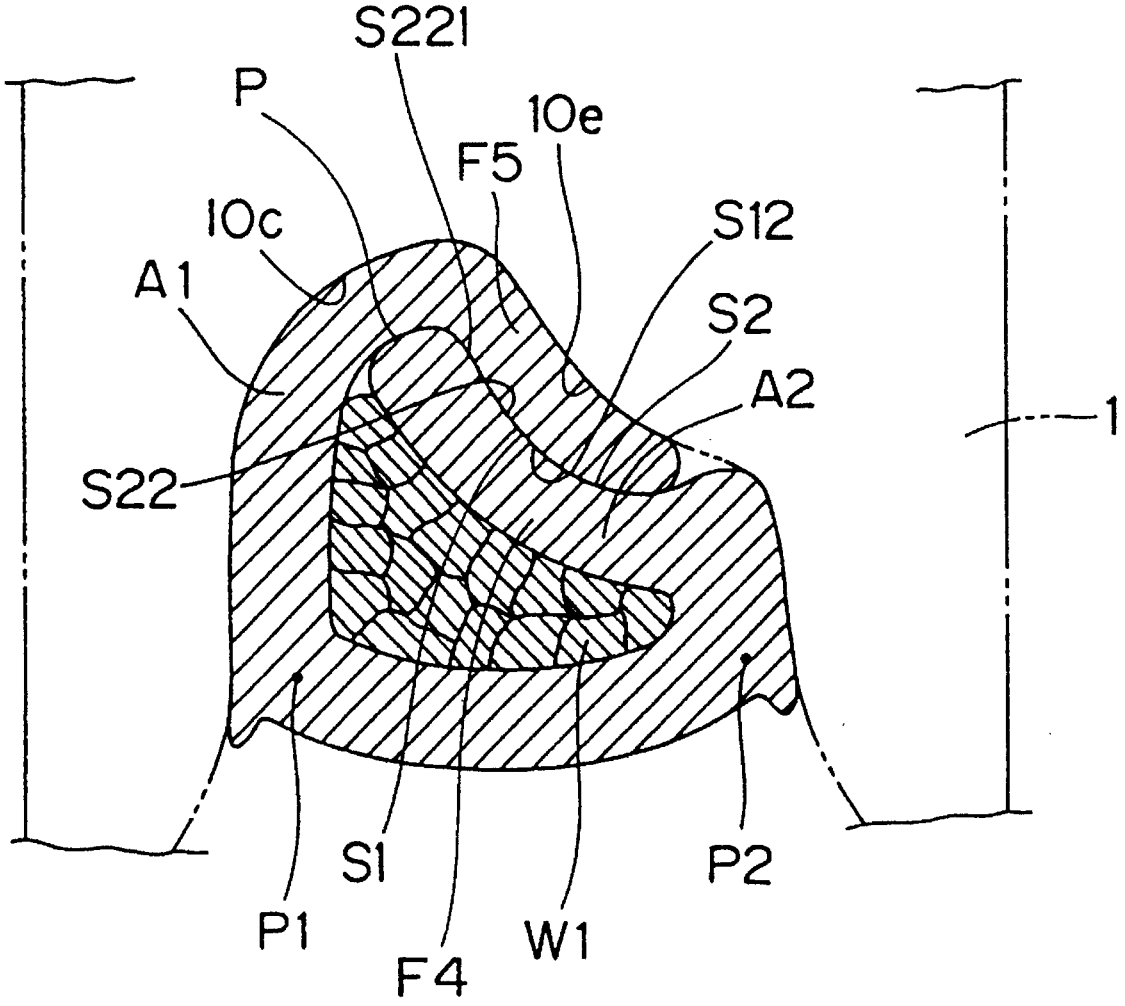
FIG. 9 is a partial sectional view illustrating a crimp terminal of still another embodiment of the present invention.
Figure 10:
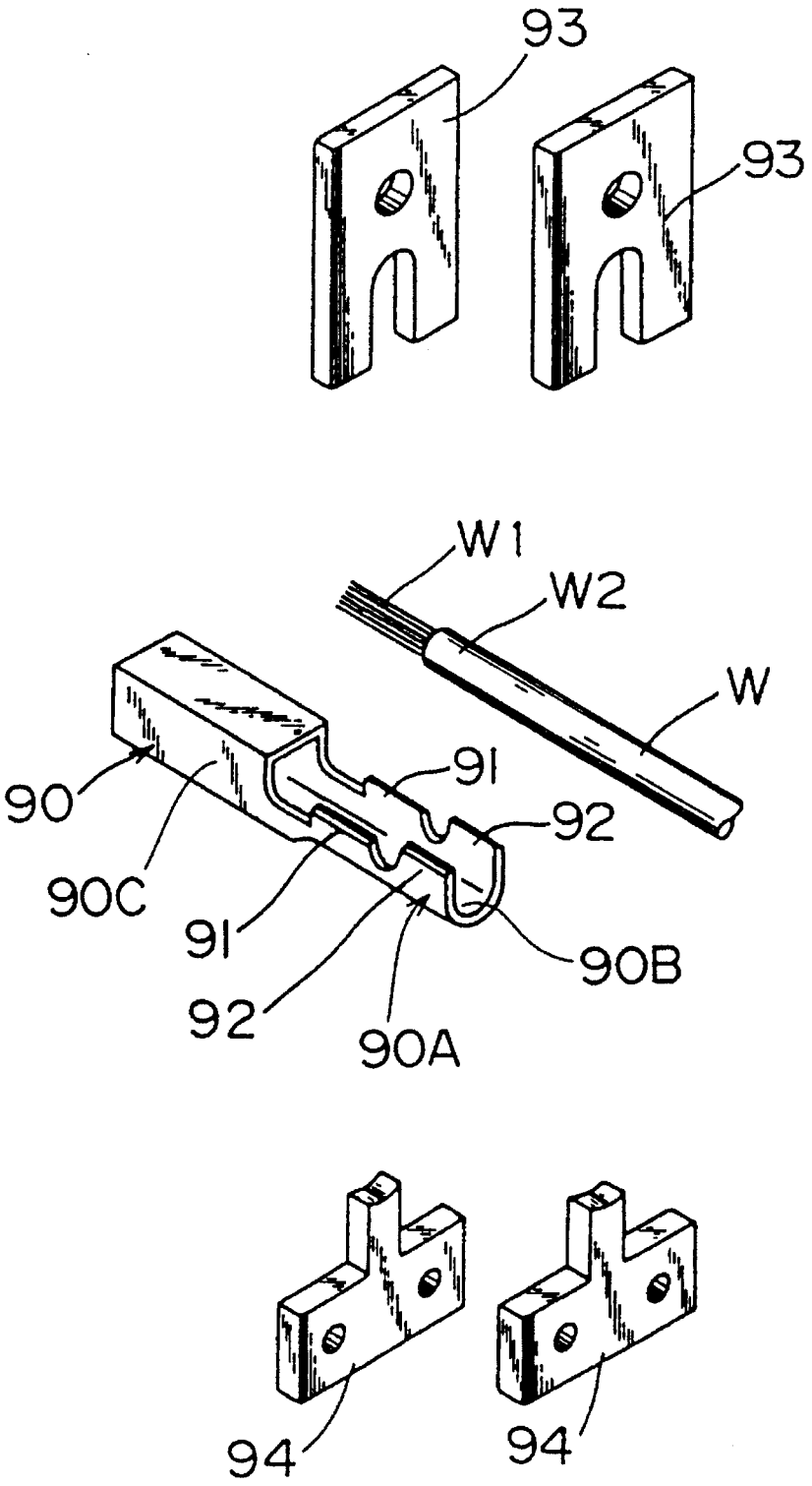
FIG. 10 PRIOR ART
FIG. 10 is a perspective view illustrating a principal part of a conventional crimp terminal and a terminal crimping device.
Figure 11:
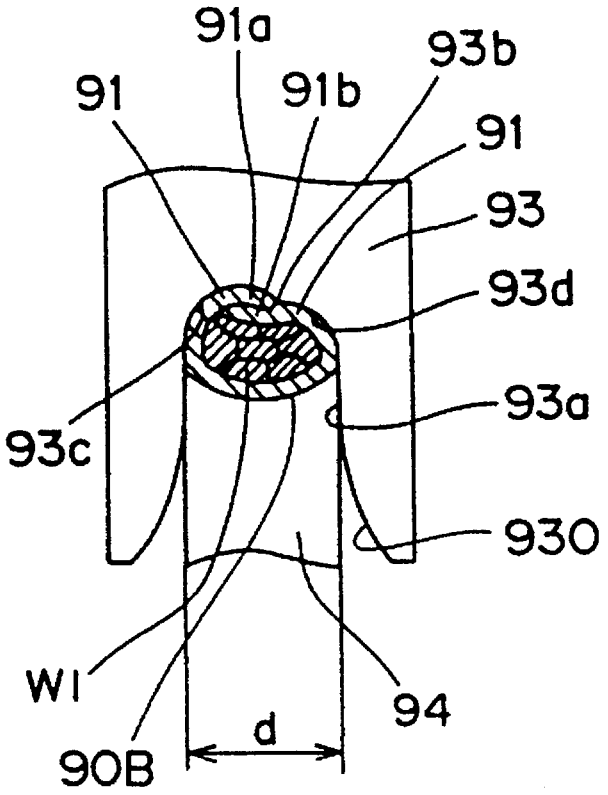
FIG. 11 PRIOR ART
FIG. 11 is a sectional view of a crimp terminal and a terminal crimping device illustrating a conventional overlap crimping.
Figure 12:
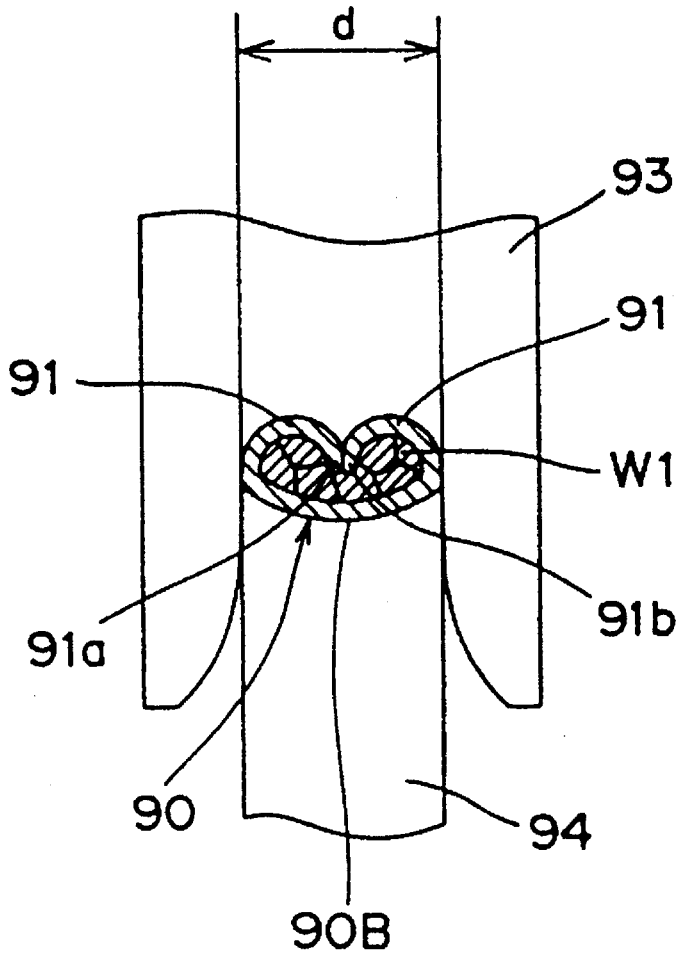
FIG. 12 PRIOR ART
FIG. 12 is a sectional view of a crimp terminal and a terminal crimping device illustrating a conventional B type crimping.
Figure 13:
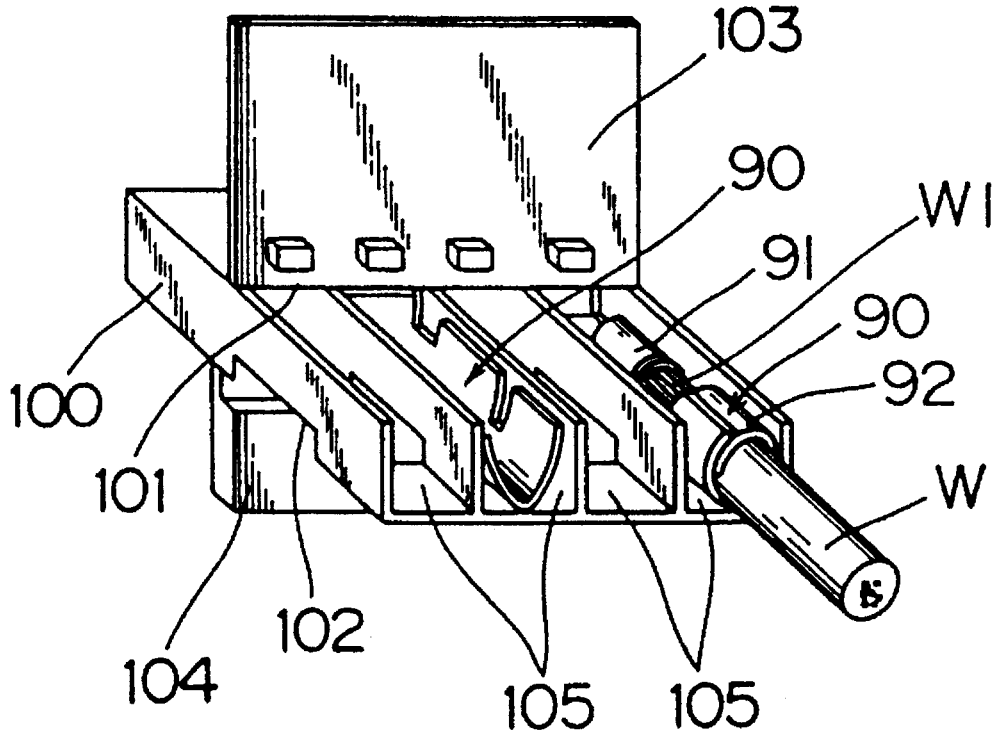
FIG. 13 PRIOR ART
FIG. 13 is a perspective view illustrating a conventional terminal connector of a type crimped in a housing.
Figures 14A, 14B, 14C:
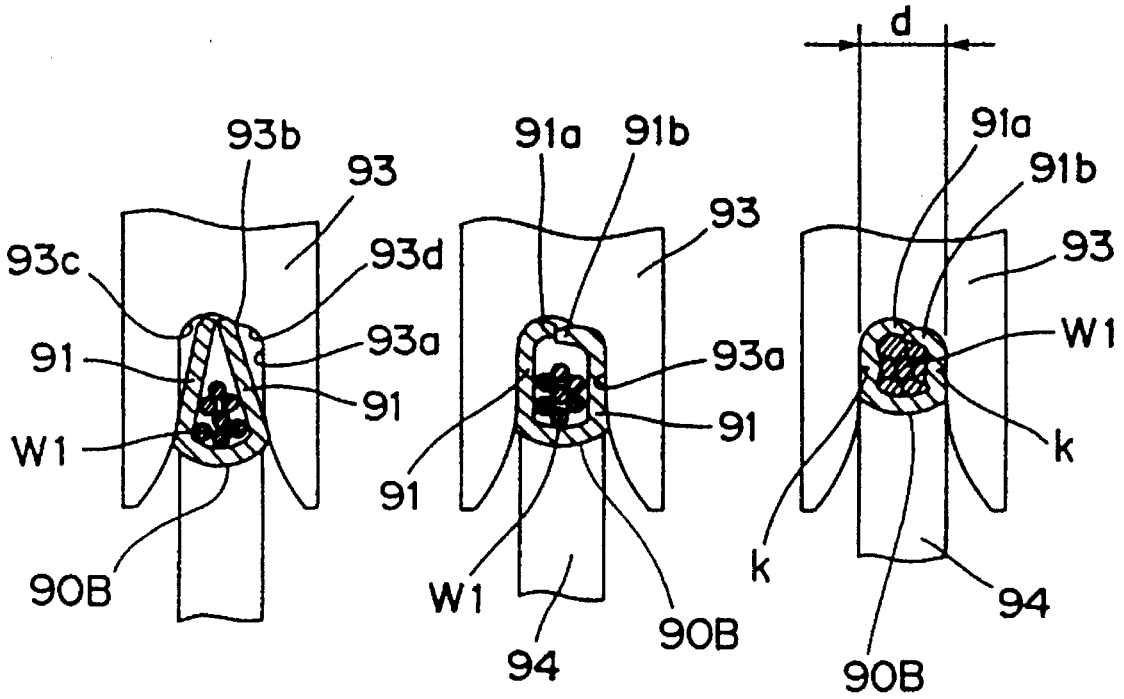
FIG. 14A FIG. 14B FIG. 14C PRIOR ART
FIGS. 14A, 14B and 14C are sectional views illustrating crimping processes in turn so as to explain a mechanism of poor crimping in a conventional overlap crimping.

FIG. 9 illustrates the state of a crimp terminal of still another embodiment of the present invention after the crimping process has been completed.

Referring to the same drawing, a difference of this embodiment from that of FIG. 8 is that the thickened section G at the tip end of the wire crimp wing A1 is eliminated and a hook portion F5 is formed in place of the hook portion F3.

Other embodiments are similar to this embodiment and, therefore, their descriptions are omitted.

On the other hand, in order to form the hook portions F4, F5 without employing the thickened section G, the projected section **10*e* is provided on the half area of the concave portion 10*c* for pressing the crimp wing A1 at the groove 10 of the crimper 1. Simultaneously with the caulking of the wire crimp wings A1, A2, the hook portions F3, F4 are formed by means of the projected section 10*e*, and the convex curved surface S12 and concave curved surface S22** are locked.

According to this embodiment, the similar effect can be accomplished and, further, the hook portion F5 is formed at the time of crimping so that it is not necessary to form the hook portion F5 in advance, which results in reduced fabrication cost.

The crimp terminal used for carrying out the present invention may be those which are projectingly provided with at least one pair of wire crimp wings A1, A2, and no level difference E may be provided between the respective wire crimp wings A1, A2.

Moreover, the present invention can be applied and carried out not only to the wire crimp wings A1, A2, but also to the insulation crimp wings A3, A4, and it can also be applied and carried out to the crimping in the interior of the housing and crimping in the exterior of the housing.

We claim:

1. A crimp terminal comprising a crimp barrel, said crimp barrel comprising a body of semicircular cross section and a couple of crimp wings which respectively integrally extend from ends of a circular arc of said body and are to be caulked around an end of an electric wire;

wherein, when said crimp wings are crimped around the end of the wire, one of said crimp wings laps over an outside of the other of said crimp wings so that said crimp wings overlap each other in an overlapped state so that said crimp wings are locked together so as to prevent each other from moving in a direction to release said overlapped state;

wherein each of said crimp wings has a hook portion having a locking surface, said hook portions of said crimp wings being lockable to each other at said locking surfaces;

wherein said locking surface of said hook portion of one of said crimp wings comprises a convex curved surface, and said locking surface of said hook portion of said the other of said crimp wings comprises a concave curved surface;

wherein said concave curved surface includes a projecting section; and wherein, when said crimp wings are crimped around an end of a wire, said projecting section projects from a circular curve, said circular curve having a center at a corner point of said crimp wing having said locking surface with said convex curve surface, said circular curve also being tangent to said convex curved surface.

2. A crimp terminal according to claim 1, wherein each of said locking surfaces of said hook portions has a portion along with a direction of curvature radius of said body.

3. A crimp terminal according to claim 1, wherein said hook portion of said one of said crimp wings includes a folded portion of which its free end is externally folded.

4. A crimp terminal according to claim 1, wherein a free end of said the other of said crimp wings is extended in a direction of curvature radius of said body and is allowed to collide with an inner surface of said one of crimp wings.

5. A crimp terminal according to claim 1, wherein said hook portion of said one of said crimp wings comprises a thickened portion.

6. A crimp terminal according to claim 5, wherein said thickened portion comprises a folded portion of which free end is folded.

7. A crimp terminal according to claim 1, wherein said one of said crimp wings is longer than said the other.

8. A process for producing a crimp terminal which has a crimp barrel caulked on an end of an electric wire, said process comprising the steps of:

providing a crimp terminal including a crimp barrel having a body of semicircular cross section and a couple of crimp wings which integrally extend from ends of circular arc of said body to be caulked around the end of the electric wire, each of said crimp wings having a hook portion with a locking surface, the locking surface of one of said crimp wings including a convex curved surface, and the locking surface of said other of the crimp wings including a concave curved surface with a projecting section;

placing said body of said crimp barrel containing the end of the electric wire on a pressure receiving surface of a pressure receiving means;

displacing said pressing surface of said pressing means to said pressure receiving surface to lead one of said crimp wings of said crimp barrel to an outer periphery of said other of said crimp wings by means of said pressing surface, thereby overlapping them to place them in an overlapped state; and additionally displacing said pressing surface so that said convex curved surface of said one crimp wing contacts said concave curved surface of said other crimp wing whereby said projecting section of said other crimp wing projects from a circular curve that has a center at a corner point at said one crimp wing and that is tangent to said convex curved surface of said one crimp wing, to thereby lock said crimp wings together so that said crimp wings prevent each other from moving in a direction to release said overlapped state.

* * * * *